US006729437B1

(12) United States Patent
Apple

(10) Patent No.: US 6,729,437 B1
(45) Date of Patent: May 4, 2004

(54) TREE STEP TOOL AND METHOD

(76) Inventor: Gregory L. Apple, 217 Cotton Rd., Reidsville, NC (US) 27320

( * ) Notice: Subject to any disclaimer, the term of this patent is extended or adjusted under 35 U.S.C. 154(b) by 0 days.

(21) Appl. No.: 10/283,491

(22) Filed: Oct. 30, 2002

(51) Int. Cl.[7] ..... E04G 3/00
(52) U.S. Cl. ..... 182/92; 182/91
(58) Field of Search ..... 182/92, 150, 127, 182/90, 189, 91, 100, 87; 81/176.15, 177.2, 121.1

(56) References Cited

U.S. PATENT DOCUMENTS 4,413,706 A * 11/1983 Michael ..... 182/91
4,669,575 A * 6/1987 Skyba ..... 182/92
4,697,669 A 10/1987 Bergsten
4,700,807 A 10/1987 Kubiak
5,624,007 A 4/1997 Mahaffy
5,743,353 A 4/1998 Browning
5,806,625 A * 9/1998 Katz ..... 182/92
5,881,837 A * 3/1999 Leicht ..... 182/92
5,899,124 A 5/1999 Cross
5,967,475 A * 10/1999 Johnson ..... 182/92

* cited by examiner

*Primary Examiner*—Hugh B. Thompson, II

(57) ABSTRACT

Mounting for portable, removable steps on tree trunks or other supports and particularly pertaining to a tool and method for easy, conveniently mounting conventional tree steps. The tool as described includes a handle axially aligned with a channel member containing an impact rod. A tree step is placed within the channel member and can then be rotated in a clockwise direction into the tree trunk or in a counter clockwise direction to remove the mounted step from the tree trunk.

17 Claims, 6 Drawing Sheets

TREE STEP TOOL AND METHOD

FIELD OF THE INVENTION

The invention herein pertains to a tool for mounting steps on a tree trunk or other support and particularly pertains to a tool which can be readily used to attach and remove conventional, portable L-shaped steps.

DESCRIPTION OF THE PRIOR ART AND OBJECTIVES OF THE INVENTION

Various designs for portable tree steps have been available for many years and used by hunters and others for climbing trees. U.S. Pat. No. 4,697,669 demonstrates a typical step having a threaded pivotal member for attachment purposes. To help attach such portable steps, a variety of tools or wrenches have been devised in the past as shown in U.S. Pat. Nos. 5,899,124, 5,743,353 and 5,624,007. Conventional tools are generally bulky and inconvenient to carry in that they have a handle at an approximate 90 degree angle to the tool body. Also, certain of the prior art tools require assembly and the use of two or more tool components increases the possibility of the tool becoming useless, should one of the components be lost.

Thus, in view of the disadvantages and difficulties using conventional tree step tools., and their limited abilities, the present invention was conceived and it is one objective thereof to provide a tool for a conventional portable L-shaped step for engaging the step for either mounting or removing the step from its mounted location.

It is still another objective of the present invention to provide a method for attaching or removing a tree step from a tree trunk using a special easy to carry tool.

It is yet another objective of the present invention to provide a tool which has a U-shaped channel member, a handle affixed to the U-shaped channel member and an impact rod contained within the U-shaped channel member for mounting a conventional tree step.

It is a further objective of the present invention to provide a tree step tool which has a handle axially aligned with the U-shaped channel member, and attached to an impact rod.

It is still another objective of the present invention to provide a tree step tool having a handle formed from a polymeric material and a U-shaped channel member formed from a rigid material such as metal.

Various other objectives and advantages of the present invention will become apparent to those skilled in the art as a more detailed description is set forth below.

SUMMARY OF THE INVENTION

The aforesaid and other objectives are realized by providing a tool for easily setting and removing portable steps from a support such as a tree trunk. The tool includes a somewhat pear-shaped handle which is in axial alignment with a U-shaped channel member. An impact rod is positioned inside the U-shaped channel member and extends toward the distal end thereof. The pear-shaped handle is affixed to the impact rod. The method of use of the tool demonstrates placing a tree step having a pivotal, pointed and threaded lug in the U-shaped channel member whereby the blunt or rear end of the threaded lug contacts the impact rod near the axle pin. The threaded lug is then positioned against a tree trunk while inside the tool whereupon the tool handle can be manually struck to drive the pointed threaded lug slightly, into the tree. Next, the tree step and tool can be turned in a clockwise direction to rotate the threaded lug into the tree trunk for securement. Once the tree step is then properly set, the tool is removed and the tree step can then pivot downwardly at the axle pin to its normal configuration against the tree and be used in climbing. The tools handle which may be formed of a polymeric material has a pear shape and is in axial alignment with the longitudinal axis of the U-shaped member. Thus, with the tree step inserted in the tool, the tool handle can be struck to start the threaded lug into the tree trunk. To remove the tree step, the tool is placed on the tree step in a different manner, with the step tread in the tool U-shaped channel member and is used to rotate the step in a counter clockwise direction, thus easily unthreading the tree step from the tree trunk or other support.

DETAILED DESCRIPTION OF THE PREFERRED EMBODIMENT AND OPERATION OF THE INVENTION

Figure 1:
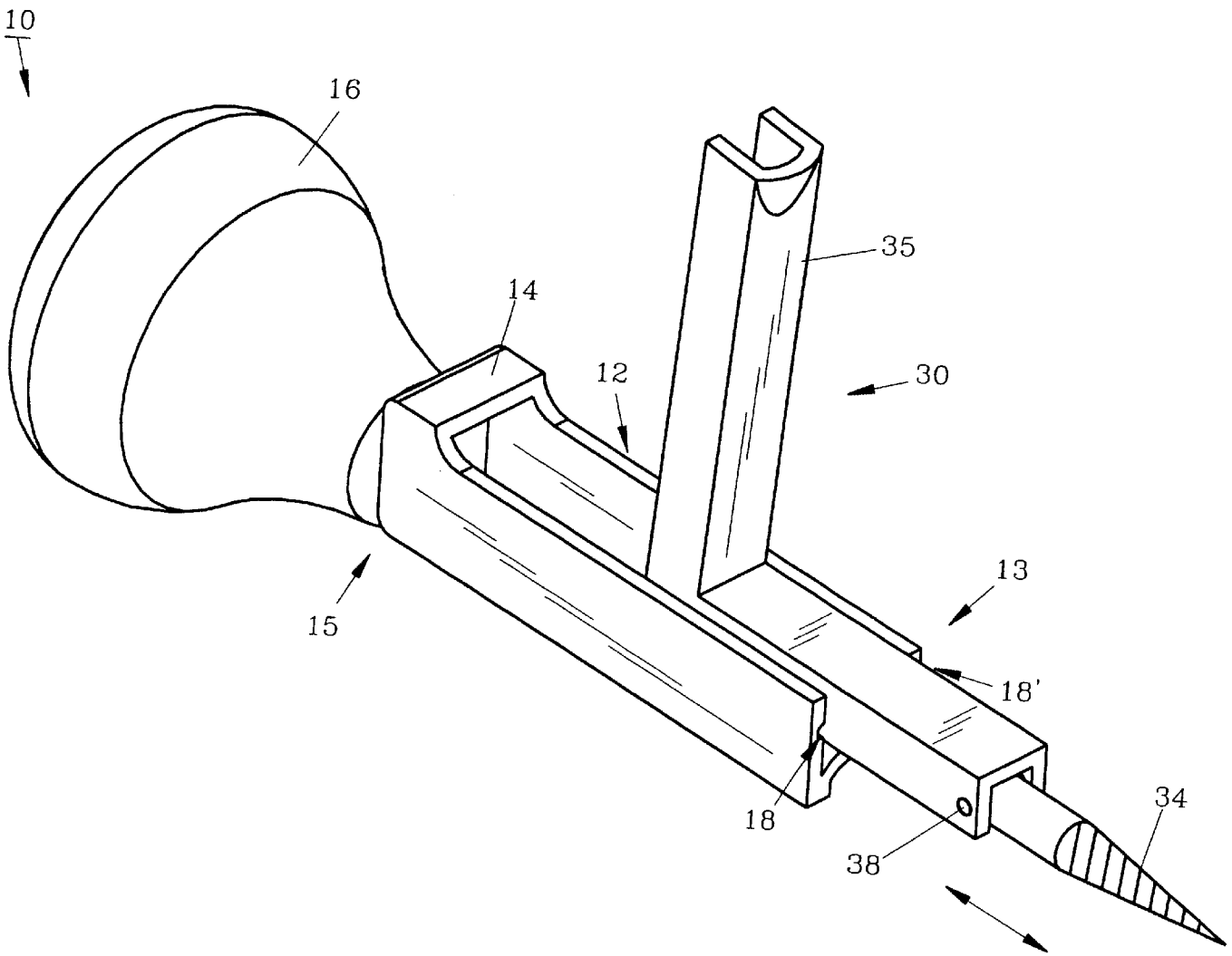
FIG. 1 demonstrates the step tool of the invention with a conventional tree step partially therewithin.
Figure 3:
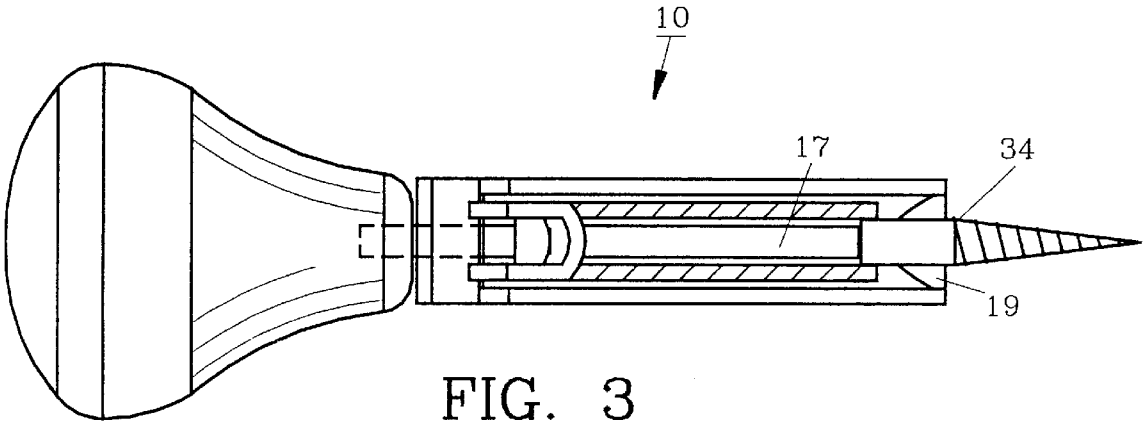
FIG. 3 shows the tool and step as seen in FIG. 2 along lines 3—3 with the top of a part of the step removed to expose the impact rod therebeneath.

For a better understanding of the invention and its operation, turning now to the drawings, FIG. 1 demonstrates preferred tree step tool 10 with a standard L-shaped portable tree step 30 partially positioned in U-shaped channel member 12. U-shaped channel member 12 includes an open distal end 13 and a channel hood 14 at proximal end 15. Affixed to U-shaped channel member 12 is a rotatable pear-shaped handle 16 which is joined to and axially aligned with impact rod 17, as shown in FIG. 3. Pin groove 18 extends about one-half the length of U-shaped channel member 12 to accommodate axle pin 38. A second pin groove 18' (not shown) is on the opposite side of U-shaped channel member 12. The axial alignment allows compact storage and carrying of tool 10 in the pockets of the pants or a jacket due to its slight bulk.

Figure 2:
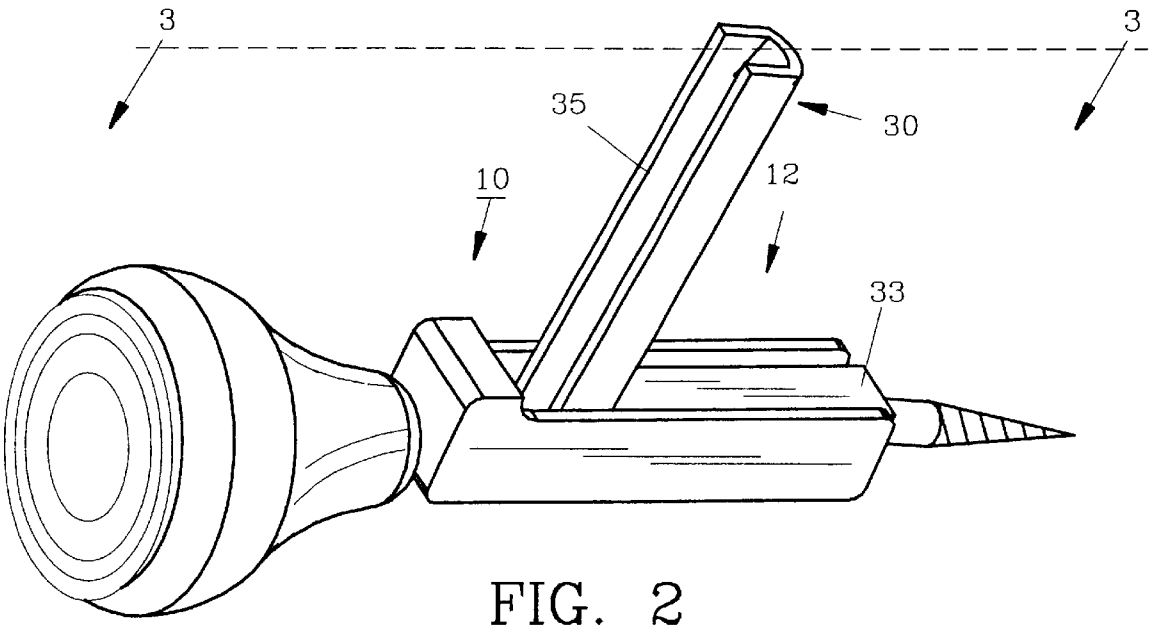
FIG. 2 illustrates the step tool as seen in FIG. 1 with the step fully positioned therein for mounting the steps on a tree or other support.
Figure 8:
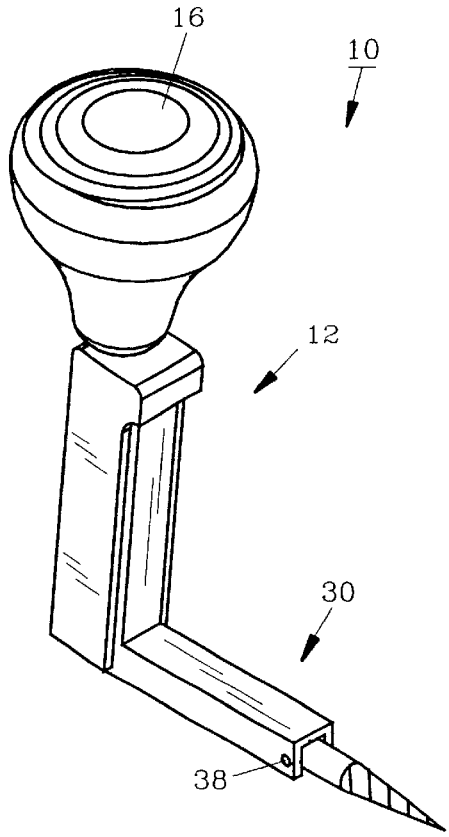
FIG. 8 illustrates the tool engaging with the step for rotation and removal of the step from the tree.
Figure 11:
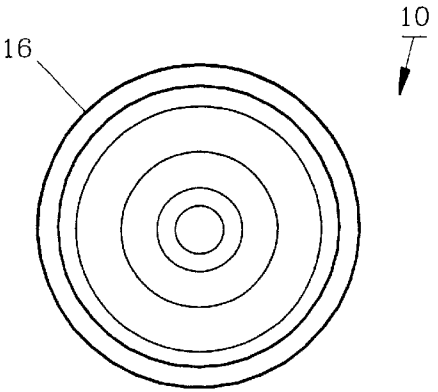
FIG. 11 features an end view of the tool along lines 11—11 as seen in FIG. 9.
Figure 9:
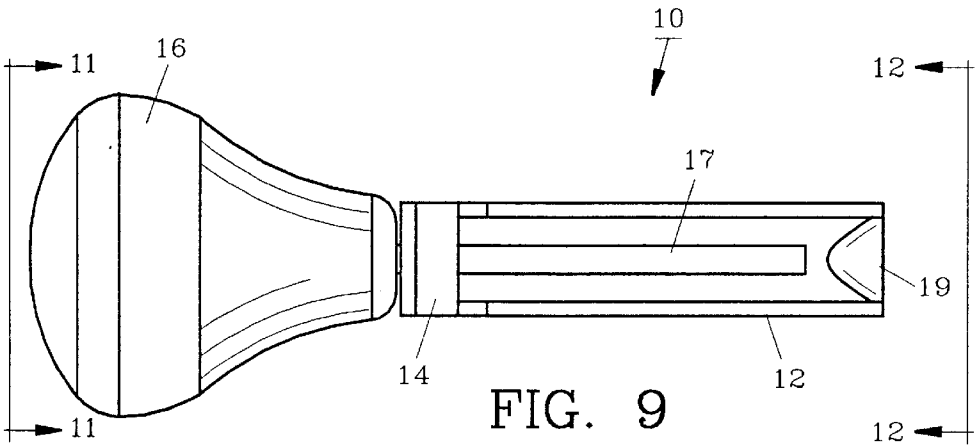
FIG. 9 shows a top view of the tree step tool with the step removed therefrom.
Figure 10:
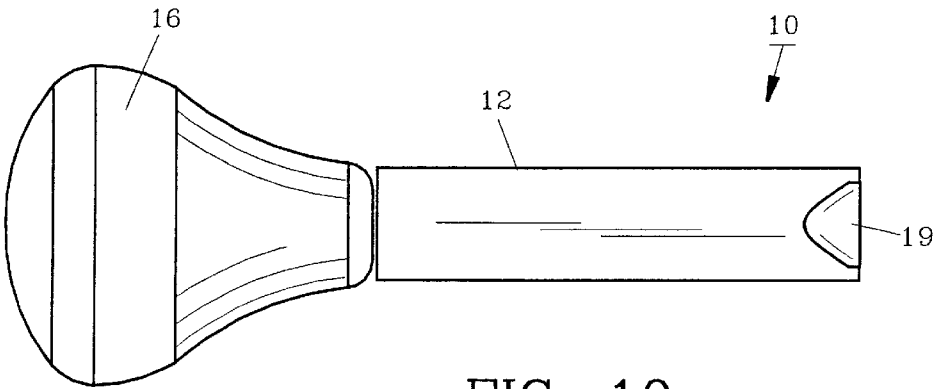
FIG. 10 shows a bottom view of the tool as seen in FIG. 9.

Pear-shaped handle 16 as seen in FIGS. 9, 10 and 11 may be formed of a hardwood, polymeric material or the like, to withstand manual blows during usage. Impact rod 17 is formed of steel and contacts threaded lug 34 of step 30 as shown in FIG. 2. This contact transfers forces from handle 16 through impact rod 17 directly to threaded lug 34, and prevents damage to axle pin 38 (seen in FIGS. 7 and 8).

Figure 12:
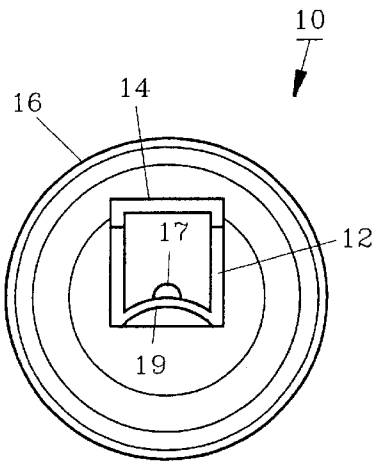
FIG. 12 demonstrates an end view of the tool as shown in FIG. 9 along lines 12—12.

In FIG. 2 tool 10 is shown with step 30 fully engaged for positioning step 30 against a vertical support such as a tree trunk or the like for mounting purposes. Impact rod 17 is shown in FIG. 3 as along lines 3—3 of FIG. 2 but with step portion 33 removed therefrom to illustrate the position of impact rod 17 in contact with threaded lug 34. Tool lip 19 as seen in FIGS. 3 and 12 maintain threaded lug 34 in an approximate horizontal position for convenience when starting lug 34 into tree trunk 55 or other support.

Figure 4:
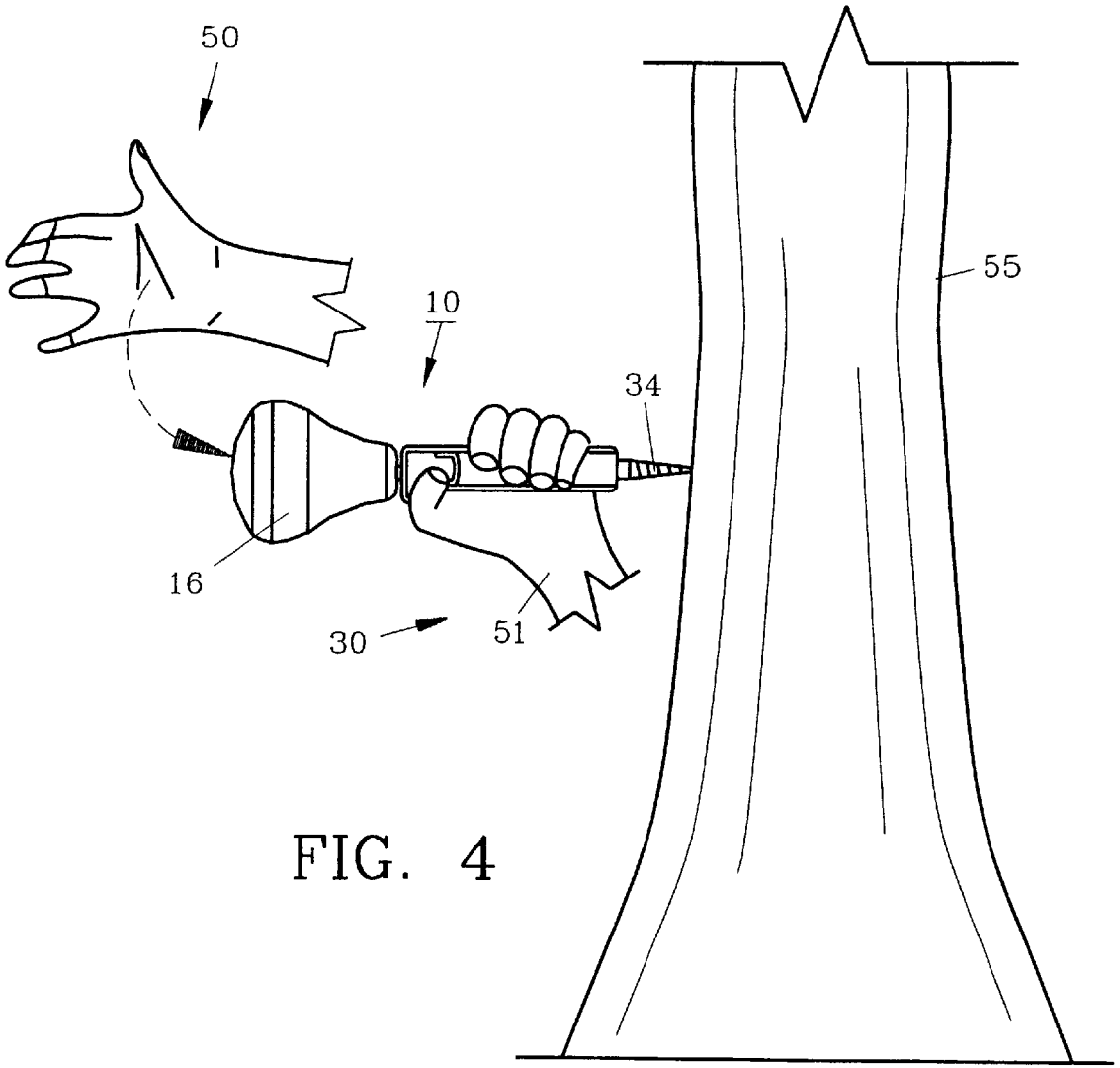
FIG. 4 features the initial stage of mounting a step on a tree trunk utilizing the tool.

To mount tree step 30 as seen in FIG. 4, right hand 50 will strike handle 16 which is connected to impact rod 17 as shown in FIG. 3 to drive threaded lug 34 into vertical support 55 which as shown is a typical tree trunk. (The tree trunk drawings herein are not intended to be to scale and only provide an illustrative example.) Left hand 51 stabilizes tool 10 while the fingers secure step 30 as right hand 50 strikes handle 16.

Figure 5:
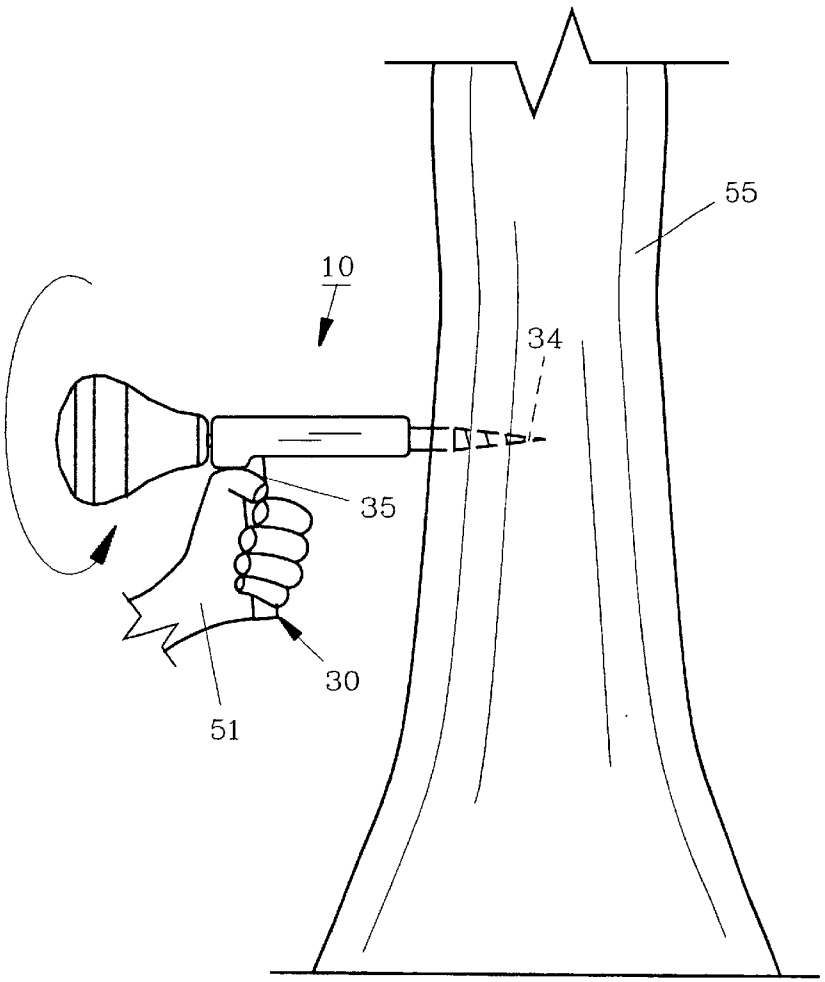
FIG. 5 pictures the rotation of the tool and step to thread the step into the tree trunk.
Figure 6:
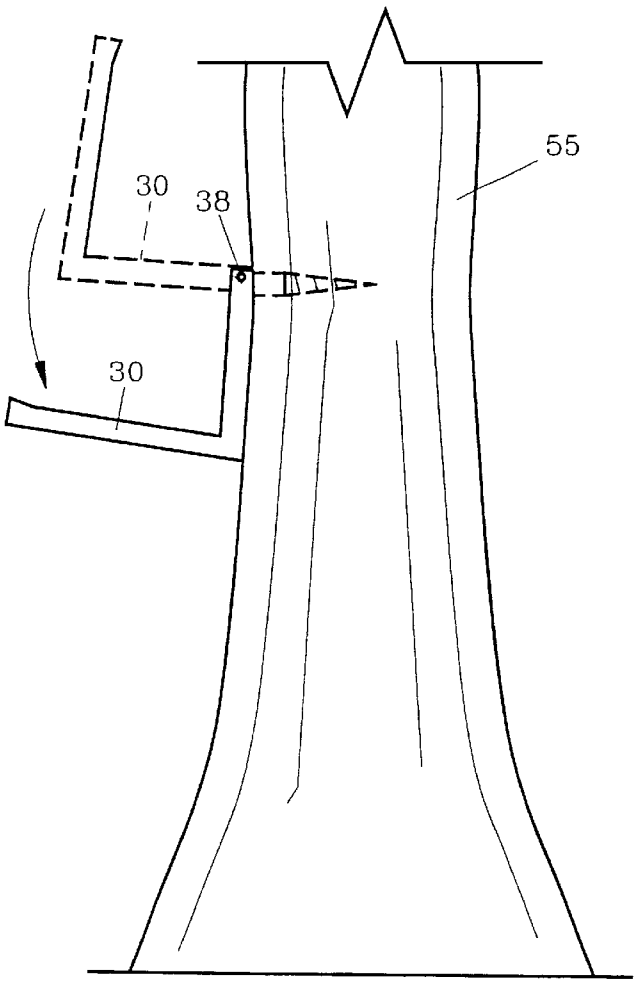
FIG. 6 depicts the step as mounted on the tree trunk and ready for use by a hunter.

Left hand 51 in FIG. 5 is shown rotating threaded lug 34 clockwise into vertical support 55. Once step 30 has been sufficiently threaded into vertical support 55, tool 10 is thereafter slidably removed. Step 30 is then rotated downward at axle pin 38 leaving step 30 therein as shown in FIG. 6. Step 30 is then ready for use by a climber, hunter or the like.

Figure 7:
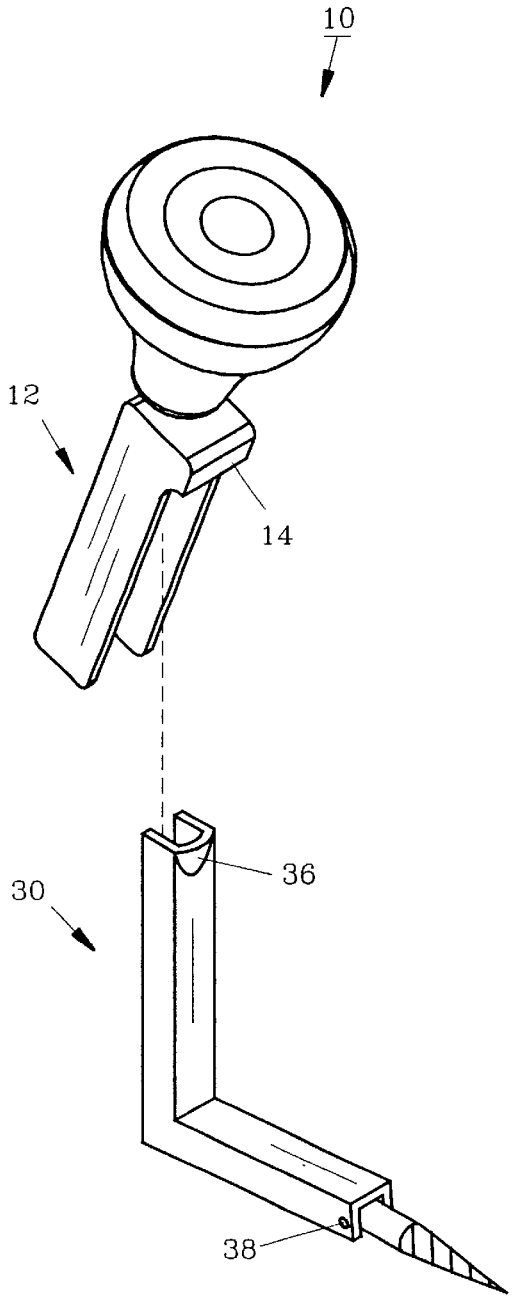
FIG. 7 demonstrates positioning the tool on the mounted tree step to remove the mounted step.

Should the user desire to remove step 30 from vertical support 55, tool 10 is held at an angle of approximately 30 degrees to allow channel hood 14 to bypass lip 36 of step 30 as shown in FIG. 7. Tool 10 is then rotated with channel hood 14 in place atop lip 36 to a vertical posture as seen in FIG. 8. With step 30 within channel member 12 of tool 10, handle 16 can be grasped and rotated in a counterclockwise direction, thus unthreading step 30 from vertical support 55. It should be realized that tool 10 fits step 30 in two ways, the first for mounting step 30 as shown in FIGS. 1–5 and a second way as shown in FIGS. 7–8, to remove step 30 when mounted.

The preferred method of mounting step 30 to a tree trunk or other support with tool 10 as shown in FIG. 1, includes the steps of, inserting a step such as step 30 into U-shaped channel member 12 with threaded lug 34 extending therefrom and with step handle 35 perpendicularly positioned to the longitudinal axis of tool 10. Next, threaded lug 34 is placed against a vertical support such as vertical support 55 presented as a tree trunk in FIGS. 4–6. Tool 10 is then impacted with a blow from hand 50 or the like to "start" threaded lug 34. Next, as seen in FIG. 5, step handle 35 of step 30 is grasped with hand 51 and is rotated in a clockwise direction to urge threaded lug 34 deeper into vertical support 55. Once step 30 has been sufficiently threaded into support 55, tool 10 is slid therefrom as shown for example in FIG. 1.

The preferred method of removing conventional step 30 includes the steps of attaching tool 10 to step 30 as shown for example in FIG. 7 and 8. Next, tool 10 is rotated in a counter clockwise direction to thus unthread step 30 from vertical support 55. Thereafter, tool 10 can be slid from step 30 for storage or the like.

The illustrations and examples provided herein are for explanatory purposes and are not intended to limit the scope of the appended claims.

I claim:

1. A tool for mounting a step on a support comprising: a handle, a U-shaped channel member, said U-shaped channel member for receiving a step having a threaded lug, said handle attached to said U-shaped channel member, said handle affixed to the proximal end of said U-shaped channel member whereby the threaded lug can be positioned against the support while the U-shaped channel member engages the step as the handle is struck to urge the threaded lug into the support.

2. The tool of claim 1 wherein said longitudinal axis of said U-shaped channel member is aligned with the axis of said handle.

3. The tool of claim 1 wherein said handle is pear-shaped.

4. The tool of claim 1 wherein said longitudinal axis of said handle is aligned with said longitudinal axis of said U-shaped channel member.

5. The tool of claim 1 further comprising an impact rod, said impact rod positioned within said U-shaped channel member for driving the threaded lug of the step.

6. The tool of claim 1 further comprising a channel hood, said hood positioned on said U-shaped channel member proximate said handle.

7. A tool for mounting a threaded step to a support comprising; a pear-shaped handle, a U-shaped channel member, a hood, said hood positioned on said U-shaped channel member, said handle affixed to the proximal end of said U-shaped channel member, said U-shaped channel member for receiving a step positioned against the support while the U-shaped channel member engages the step as the handle is struck to urge the threaded lug into the support.

8. The tool of claim 7 further comprises an impact rod, said impact rod contained within said U-shaped channel member for applying force to said threaded lug as said handle is struck.

9. The tool of claim 7 further comprises a hood, said hood positioned proximate said handle and on said U-shaped channel member.

10. The tool of claim 7 wherein pear-shaped handle is axially aligned with said U-shaped channel member.

11. A method of mounting a step having a pivotable, threaded lug to a support with a tool having a handle and a U-shaped channel member with an impact rod within the U-shaped channel member, the method comprising the steps of:

a) inserting the step in the U-shaped channel member with the threaded lug proximate the impact rod and extending therefrom;

b) placing the threaded lug against the support;

c) striking the handle to drive the threaded lug into the support; and d) rotating the tool and step to rotate the threaded lug into the support.

12. The method of claim 11 wherein inserting the step into the U-shaped channel member comprises the method step of manually placing the step into the U-shaped channel member.

13. The method of claim 11 wherein placing the threaded lug against the support comprises the method step of placing the threaded lug against a tree trunk.

14. The method of claim 11 wherein striking the handle comprises the method step of striking the handle with the hand.

15. The method of claim 11 whereby rotating the tool comprises the method step of rotating the tool in a clockwise direction to rotate the threaded lug into the support.

16. The method of claim 11 further comprising the method step of removing the tool from the step.

17. The method of claim 16 further comprising the method step of repositioning the step into the U-shaped channel member and removing the step from the support by rotating the step in a counter clockwise direction.

* * * * *